US005434607A

United States Patent [19]

Keefe

[11] Patent Number: 5,434,607

[45] Date of Patent: Jul. 18, 1995

[54] ATTACHMENT OF NOZZLE PLATE TO FLEXIBLE CIRCUIT FOR FACILITATING ASSEMBLY OF PRINTHEAD

[75] Inventor: Brian J. Keefe, La Jolla, Calif.

[73] Assignee: Hewlett-Packard Company, Palo Alto, Calif.

[21] Appl. No.: 62,976

[22] Filed: May 14, 1993

Related U.S. Application Data

[63] Continuation-in-part of Ser. No. 862,086, Apr. 2, 1992, Pat. No. 5,278,584.

[51] Int. Cl.[6] ..... B41J 2/14

[52] U.S. Cl. ..... 347/50; 347/87; 439/83

[58] Field of Search ..... 347/13, 50, 67, 87, 347/47; 439/67, 77, 83, 329

[56] References Cited

U.S. PATENT DOCUMENTS

| | | | |
|---|---|---|---|
| 4,806,106 | 2/1989 | Mebane et al. | 347/50 |
| 4,881,318 | 11/1989 | Komuro et al. | 347/50 |
| 5,016,023 | 5/1991 | Chan et al. | 347/50 |
| 5,189,787 | 3/1993 | Reed et al. | 347/50 |
| 5,237,343 | 8/1993 | Osada | 347/67 |
| 5,278,584 | 1/1994 | Keefe et al. | 347/87 |

*Primary Examiner*—Benjamin R. Fuller
*Assistant Examiner*—John E. Barlow, Jr.

[57] ABSTRACT

In a printhead assembly, a nozzle plate is bonded directly to special traces formed on a flexible tape automated bonding (TAB) circuit, using a commercially available automatic lead bonder, to retain the nozzle plate in place on the TAB circuit. The TAB circuit is handled in a reel-to-reel film format which is commonly used for electronic chip packaging. In a next step of the reel-to-reel process, an automatic bonder manipulates individual substrates, aligns each substrate to an associated nozzle plate, and bonds electrodes on the substrate to corresponding leads formed on the TAB circuit. In the process of the automated bonder aligning the substrate to the nozzle plate, the substrate is automatically aligned with respect to the leads on the TAB circuit. Commercially available automatic bonding equipment can be used to perform the alignment and bonding steps.

22 Claims, 5 Drawing Sheets

ATTACHMENT OF NOZZLE PLATE TO FLEXIBLE CIRCUIT FOR FACILITATING ASSEMBLY OF PRINTHEAD

RELATED APPLICATION

This application is a continuation-in-part application of application Ser. No. 862,086 filed Apr. 2, 1992 now U.S. Pat. No. 5,278,584 dated Jan. 11, 1994, Inventors: Keefe et al. and assigned to Applicant's assignee.

The present invention generally relates to inkjet printheads and, more particularly, to an improved method for fabricating an inkjet printhead.

BACKGROUND OF THE INVENTION

Inkjet printheads operate by ejecting a droplet of ink through a nozzle and onto a recording medium, such as a sheet of paper. When a number of nozzles are arranged in a pattern, such as one or more linear arrays, the properly sequenced ejection of ink from each nozzle causes characters or other images to be printed on the paper as the printhead is moved relative to the paper. The paper is typically shifted each time the printhead has moved across the paper. The printhead is usually part of a disposable print cartridge containing a supply of ink, where the print cartridge is easily installed in and removed from the printer.

In one design of a thermal inkjet print cartridge, the print cartridge includes: 1) an ink reservoir and ink channels to supply ink proximate to each of the nozzles; 2) a nozzle plate in which the nozzles are formed in a certain pattern; and 3) a substrate attached to a bottom surface of the nozzle plate, where a series of thin film heaters are formed on the substrate, generally one below each nozzle. Each heater includes a thin film resistor and appropriate current leads. To print a single dot of ink, an electrical current from an external power supply is passed through a selected heater. The heater is ohmically heated, in turn superheating a thin layer of the adjacent ink. This results in explosive vaporization of the ink, causing a droplet of ink to be ejected through an associated nozzle onto the paper.

One example of this type of print cartridge is shown in FIG. 1 as print cartridge 10. Print cartridge 10 generally includes a body 12 which acts as an ink reservoir. Body 12 may have formed on it one or more projections, such as projection 13, to enable print cartridge 10 to be secured in place within an ink printer. The printhead portion 14 of print cartridge 10 includes a metal nozzle plate 16 (such as a gold-plated nickel nozzle member), which has two parallel arrays of nozzles 17 formed in it using conventional photolithographic techniques or other known techniques. Nozzle plate 16 is attached by an adhesive to an underlying substrate (not shown) which includes heater resistors paired with each of nozzles 17.

A flexible insulating tape 18 has formed on it a number of conductors which terminate in contact pads 20. The other ends of the conductors on tape 18 are connected, using tape automated bonding (TAB), to electrodes on the substrate.

When print cartridge 10 is properly installed in a moveable carriage of an inkjet printer, pads 20 contact corresponding electrodes on the inkjet printer which supply the energization signals to the various heater resistors on the substrate. When printing, the carriage scans print cartridge 10 across the width of a sheet of paper, and the paper is incrementally moved perpendicular to the direction of movement of print cartridge 10.

To assemble the combined prior art structure of tape 18, nozzle plate 16, and the underlying substrate, nozzle plate 16 is first aligned with and secured to the substrate such that the heater resistors on the substrate are aligned with the nozzles formed on the nozzle plate. This is a fairly time consuming process which requires specially designed and expensive machinery for dispensing a UV curable adhesive on the substrate, manipulating the nozzle plates and substrates, aligning them, and then adhesively securing the nozzle plates to the substrates by curing the UV curable adhesive sandwiched between nozzle plate 16 and the substrate.

After the step of aligning and securing nozzle plate 16 to the substrate, a conventional tape automated bonding (TAB) process, performed by a commercially available automated bonding machine, is then carried out to position electrodes on the substrate with respect to conductors formed on tape 18 and bond the conductors to the substrate electrodes.

What is needed is a method for manufacturing inkjet printheads which does not entail the use of specially designed equipment for dispensing a UV curable adhesive, manipulating nozzle plates and substrates, aligning them, and curing the adhesive but only entails using commercially available equipment.

SUMMARY OF THE INVENTION

The inventive method bonds a nozzle plate directly to special conductors on a flexible TAB circuit, using a commercially available automatic lead bonder, to retain the nozzle plate in place on the TAB circuit. The TAB circuit is handled in a reel-to-reel film format which is commonly used for electronic chip packaging. The commercially available lead bonder is programmed to manipulate each nozzle plate, align the special conductors formed on the TAB circuit with respect to the nozzle plate, and bond these conductors to the nozzle plate.

In a next stage of the reel-to-reel process, an identical automatic bonder (or the same bonder) manipulates individual substrates, aligns each substrate to an associated nozzle plate, and bonds electrodes on the substrate to corresponding leads formed on the TAB circuit. In the process of aligning the substrate to the nozzle plate, the substrate is automatically aligned with respect to the leads on the TAB.

Thus, such an assembly requires only relatively inexpensive, commercially available bonding equipment, which already possesses the capability to manipulate the individual nozzle plates and substrates, optically align them, and perform the required bonding steps.

A next step in the reel-to-reel process may laminate the nozzle plate to the substrate simply by applying heat and pressure to the paired substrate and nozzle plate.

BRIEF DESCRIPTION OF THE DRAWINGS

The present invention can be further understood by reference to the following description and attached drawings which illustrate the preferred embodiments.

Other features and advantages will be apparent from the following detailed description of the preferred embodiments, taken in conjunction with the accompanying drawings, which illustrate, by way of example, the principles of the invention.

DETAILED DESCRIPTION OF THE PREFERRED EMBODIMENTS

Figure 2:
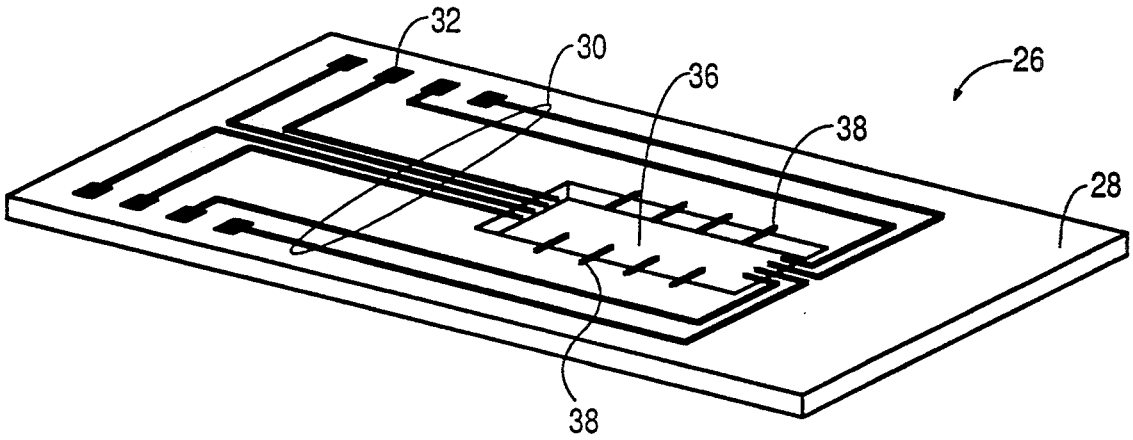
FIG. 2 illustrates a TAB circuit prior to a printhead being affixed thereto.

FIG. 2 illustrates a back surface of a tape automated bonding (TAB) circuit 26 comprising a flexible polymer tape 28 approximately 2 mils thick. Such tape 28 may be purchased commercially as Kapton TM tape, available from 3M Corporation. Other suitable tape may be formed of Upilex TM or its equivalent. Preferably, tape 28 is formed of a polyimide.

Shown on the back surface of tape 28 are conductive traces 30 formed thereon using a conventional metal deposition and photolithographic etching process. Traces 30 may be conventional gold-plated copper conductors. These conductive traces 30 are terminated by large contact pads 32, extending through tape 28, designed to interconnect with a printer. When TAB circuit 26, with a printhead subsequently attached, is secured to a print cartridge body, such as print cartridge body 12 in FIG. 1, and the print cartridge is installed in a printer, contact pads 32 contact printer electrodes providing externally generated energization signals to the printhead.

Figure 5:
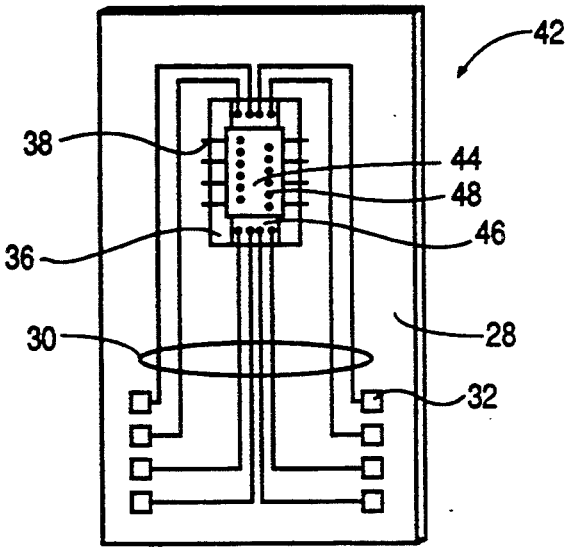
FIG. 5 illustrates an opposite surface of the TAB circuit shown in FIG. 3.

Contact pads 32 are preferably plated with gold on the front surface of tape 28 (shown in FIG. 5).

The other ends of conductors 30 extend out over rectangular opening 36 for connection to electrodes on a substrate containing heater resistors.

Also formed on the back surface of TAB circuit 26 using conventional photolithographic techniques are additional traces 38, which are not connected to any contact pads, since these traces 38 are not intended to conduct electrical signals. Rather, traces 38 are intended to be directly bonded to a nozzle plate for securing the nozzle plate in position with respect to TAB circuit 26. Traces 38 may have virtually any size and number needed to adequately secure a nozzle plate with respect to TAB circuit 26. All that is necessary is that traces 38 are located inclose proximity to opening 36 to enable bonding the ends of traces 38 to a nozzle plate positioned within opening 36, as will be subsequently described.

TAB circuit 26 with specially designed traces 30 and 38 formed thereon may be obtained from 3M Corporation.

Figure 3:
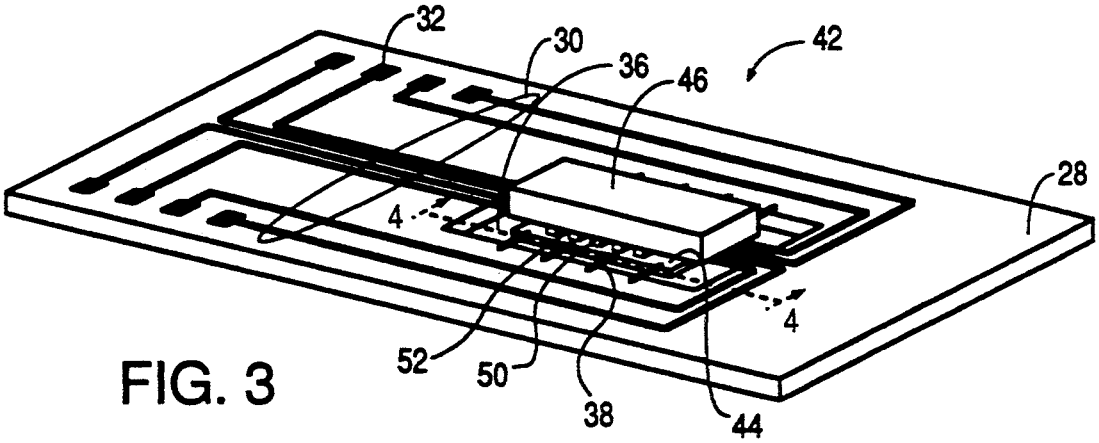
FIG. 3 illustrates the TAB circuit of FIG. 2 after special conductors on the TAB circuit have been bonded to a nozzle plate and after current-carrying leads of the TAB circuit have been bonded to electrodes on a substrate.

FIG. 3 illustrates the completed TAB printhead assembly 42 incorporating a nozzle plate 44 aligned with and bonded to traces 38 and including a silicon substrate 46 aligned with nozzle plate 44 and having electrodes bonded to the ends of traces 30. As will be described in more detail later with respect to FIG. 10, a conventional automated bonder performs these alignment and bonding steps. A front surface of TAB printhead assembly 42 in FIG. 3 is shown in FIG. 5. (Traces 30 and 38 are shown visible in FIG. 5 since tape 28 is assumed to be semi-transparent).

Nozzle plate 44 having nozzles 48 (FIG. 5) formed therein may be formed using a suitable lithographic electroforming process such as described in U.S. Pat. No. 4,773,971, entitled "Thin Film Mandrel," issued to Lam et al. on Sep. 27, 1988. This '971 patent is incorporated herein by reference. In such a process, the orifices in the nozzle plate are formed by overplating nickel around dielectric disks. Other types of nozzle plates having nozzles 48 formed therein may be formed using any other known and conventional process, and the nozzle plate 44 material may comprise metal or any other material which may be bonded to traces 38 using a conventional automated bonder. In a preferred embodiment, nozzle plate 44 is nickel with gold plating.

After nozzle plate 44 is aligned and bonded to traces 38 using a commercial automated bonder, substrate 46 is then aligned with respect to nozzle plate 44, also using a commercial automated bonder, and the ends of traces 30 are bonded to electrodes on the surface of substrate 44 using opening 36 in tape 28 to gain access to the ends of traces 30 and the electrodes on substrate 46.

FIG. 3 also illustrates an edge portion of a barrier layer 50 defining ink channels 52 and vaporization chambers (to be described later), whereby ink flows into ink channels 52 and is ejected from an associated nozzle 48 by the energization of an associated heater resistor.

Figure 4:
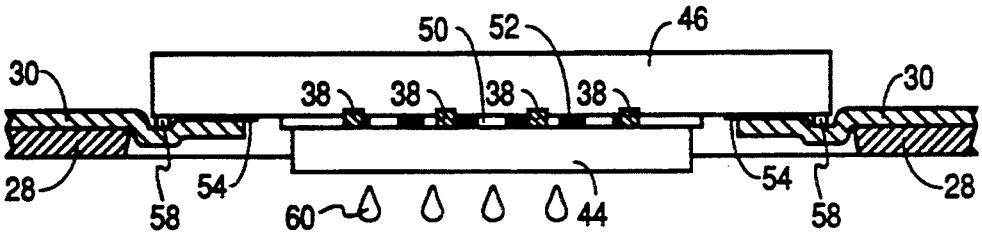
FIG. 4 is a cross-section along line 4—4 in FIG. 3.

FIG. 4 illustrates a cross-section of TAB printhead assembly 42 along line 4—4 in FIG. 3 which shows nozzle plate 44 being secured to substrate 46. As seen, traces 38 on tape 28 are bonded to a back surface of nozzle plate 44. Traces 30 are bonded to electrodes 54 on substrate 46 for providing energization signals to heater resistors formed on substrate 46. Barrier layer 50 and ink channels 52 are also revealed. Barrier layer 50 may be formed of a photoresist which is defined using conventional photolithographic techniques. The same photoresist which forms barrier layer 50 is also formed to provide an insulating portion 58 to insulate traces 30 from the edges of silicon substrate 46.

Also shown in FIG. 4 are ink droplets 60 being ejected from nozzles 48 (FIG. 5) in nozzle plate 44.

Figure 6:
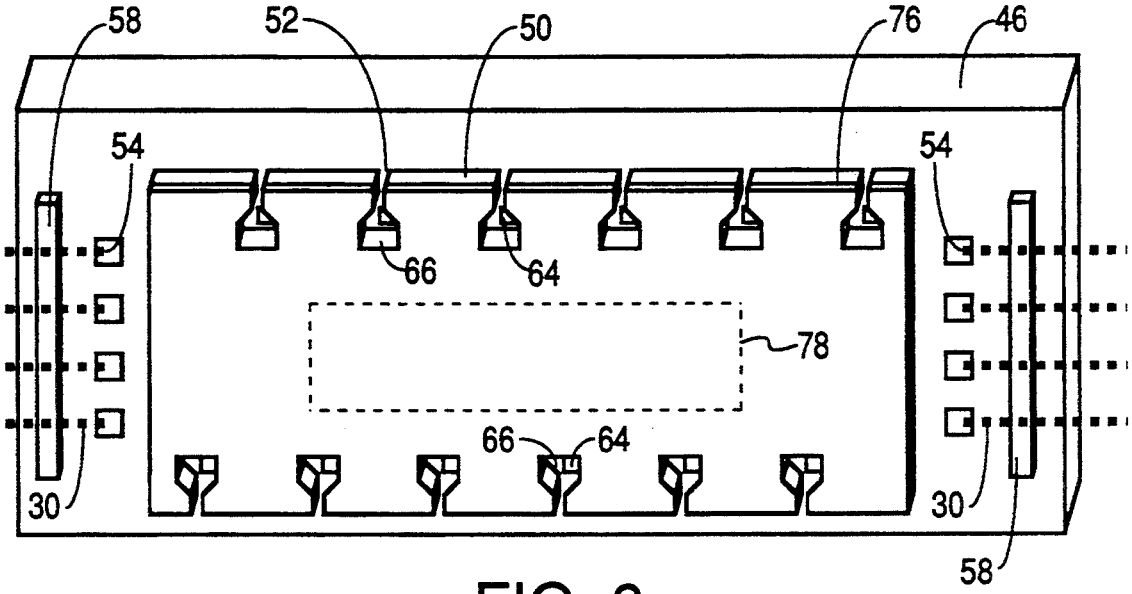
FIG. 6 illustrates one embodiment of a substrate which may be attached to the TAB circuit of FIG. 3.

FIG. 6 is a front view, in perspective, of a silicon substrate 46 which may be affixed to the back of nozzle plate 44 in FIG. 3 to form TAB printhead assembly 42.

Substrate 46 has formed on it, using conventional photolithographic techniques, two rows of thin film resistors 64, shown in FIG. 6 exposed through vaporization chambers 66 formed in barrier layer 50.

In one embodiment, substrate 46 is approximately one-half inch long and contains 300 heater resistors 64, thus enabling a resolution of 600 dots per inch.

Also, formed on substrate 46 are electrodes 54 for connection to conductive traces 30 (shown by dashed lines) formed on the back of tape 28 in FIG. 3.

A demultiplexer 78, shown by a dashed outline in FIG. 6, is also formed on substrate 46 for demultiplexing the incoming multiplexed signals applied to electrodes 54 and for distributing the signals to the various thin film resistors 64. Demultiplexer 78 enables the use of much fewer electrodes 54 than thin film resistors 64. Demultiplexer 78 may be any decoder for decoding encoded signals applied to electrodes 54.

Insulating portion 58 of barrier layer 50 insulates conductive traces 30 from the underlying substrate 46.

In order to adhesively affix the top surface of barrier layer 50 to the back surface of nozzle plate 44, a thin adhesive layer 76, such as an uncured layer of photoresist, is applied to the top surface of barrier layer 50. The type of adhesive layer 76 used depends on the nozzle plate 44 material. Other adhesives may include thermoset polymers, thermoplastic polymers, or any other suitable adhesive. In addition, direct bonding to barrier layer 50 without adhesive layer 76 may be possible.

The resulting substrate structure of FIG. 6 is then positioned with respect to the back surface of nozzle plate 44 so as to align the substrate structure with respect to nozzle plate 44. Traces 30 are then bonded to electrodes 54. This alignment and bonding process is described in more detail later with respect to FIG. 10.

The aligned and bonded substrate/nozzle plate structure is then heated while applying pressure to cure any adhesive layer 76 to firmly affix the substrate structure to the back surface of nozzle plate 44.

Figure 7:
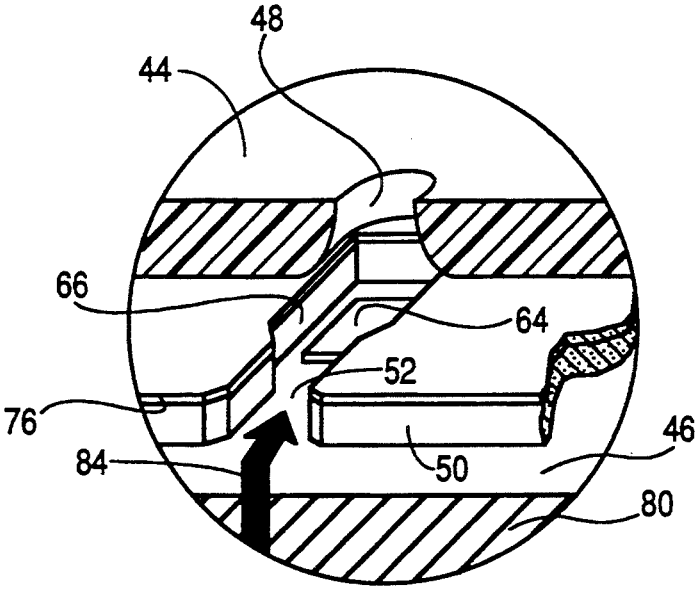
FIG. 7 is a perspective view, partially cut away, of a portion of the printhead assembly showing the alignment of a nozzle with respect to a vaporization chamber and a heater resistor.

FIG. 7 is an enlarged view of a single vaporization chamber 66, thin film resistor 64, and nozzle 48 after the substrate structure of FIG. 6 is secured to the back surface of nozzle plate 44 using an appropriate adhesive layer 76. A side edge of substrate 46 is shown as edge 80. In operation, ink flows from an ink reservoir such as provided by print cartridge body 12 in FIG. 1, around the side edge 80 of substrate 46, and into ink channel 52 and associated vaporization chamber 66, as shown by arrow 84. Upon energization of thin film resistor 64, a thin layer of the adjacent ink is superheated, causing explosive vaporization and, consequently, causing a droplet of ink to be ejected through nozzle 48. Vaporization chamber 66 is then refilled by capillary action.

In the preferred embodiment, substrate 46 is approximately 20 mils thick, barrier layer 50 is approximately 1 mil thick, and nozzle plate 44 is approximately 2 mils thick.

Figure 1:
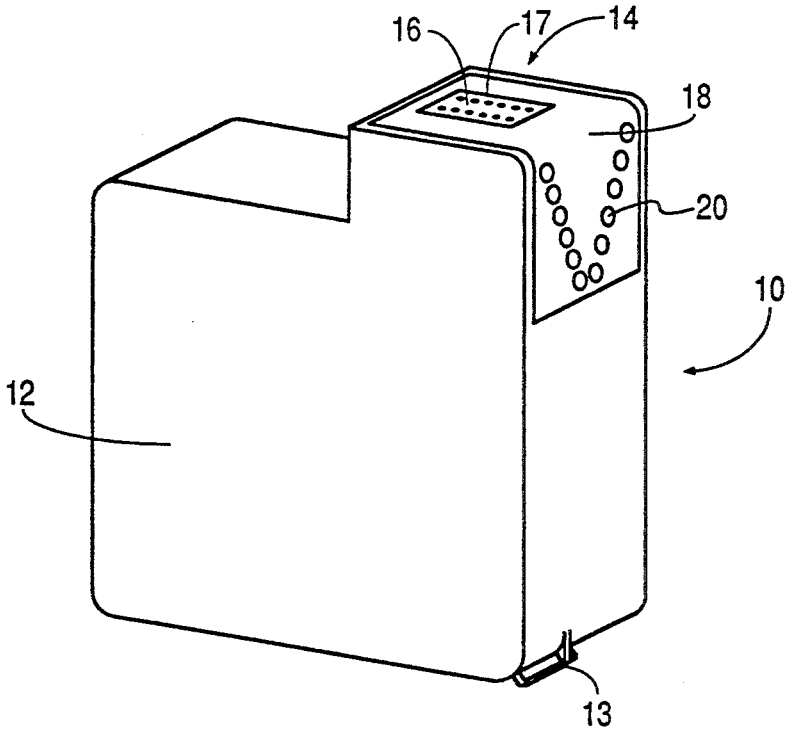
FIG. 1 (PRIOR ART)
FIG. 1 is a perspective view of a conventional inkjet print cartridge whose methods of manufacturing suffer from the above-described drawbacks.
Figure 8:
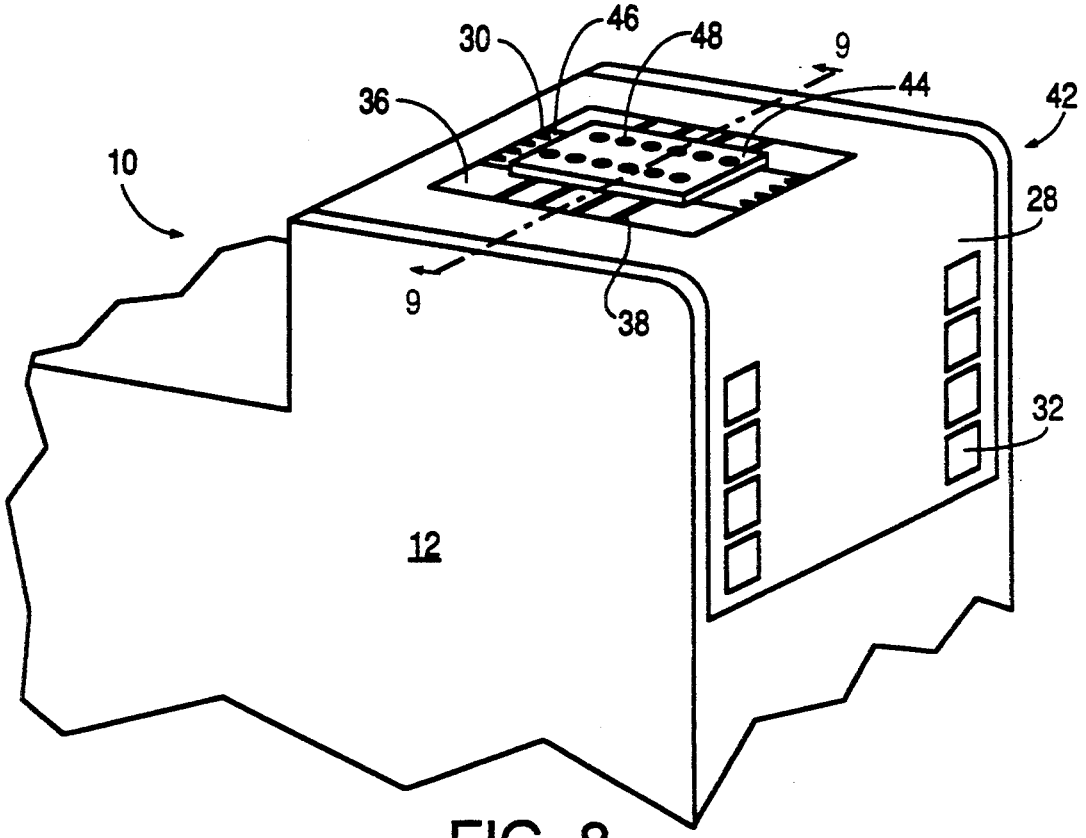
FIG. 8 illustrates a portion of a print cartridge after the TAB printhead assembly of FIG. 5 has been affixed to a plastic print cartridge body.

FIG. 8 shows a portion of a print cartridge after TAB printhead assembly 42 has been mounted on a print cartridge body, such as print cartridge body 12 in FIG. 1.

Figure 9:
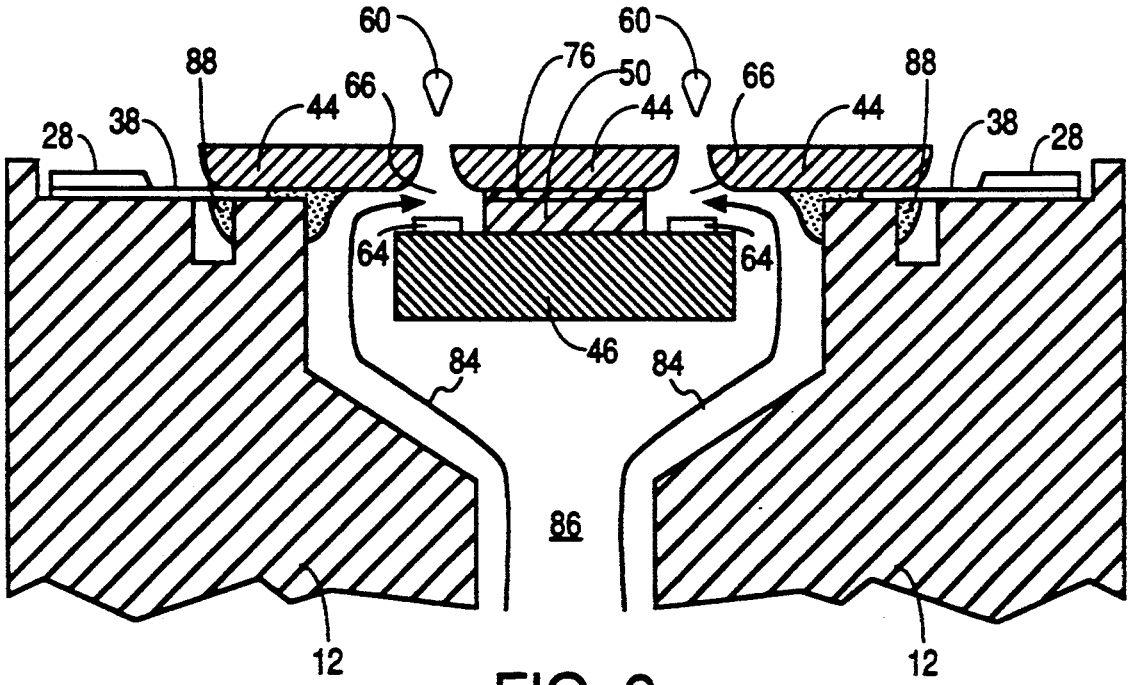
FIG. 9 is a cross-sectional view taken along line 9—9 in FIG. 8.

Shown in FIG. 9 is a side-elevational view in cross-section taken along line 9—9 in FIG. 8. FIG. 9 shows the path 84 of ink from within plastic print cartridge body 12, through an ink opening 86, and around the edges of substrate 46 into vaporization chambers 66.

An adhesive seal 88, using epoxy or any other suitable adhesive, circumscribes substrate 46 and forms an ink seal between the back surface of nozzle plate 44 and the plastic print cartridge body 12.

Elements identified in FIG. 9 with the same element numbers as those elements shown in FIGS. 2–8 are identical elements.

The attachment of nozzle plate 44 to traces 38 is shown in the particular embodiment of FIG. 8 as extending between nozzle plate 44 and print cartridge body 12.

Nozzles 48 formed in nozzle plate 44 are preferably tapered for various well known reasons. Methods for forming such tapered nozzles include electroforming or other well-known techniques.

Accordingly, a novel printhead assembly has been shown and described which provides numerous advantages over a prior art printhead.

Figure 10:
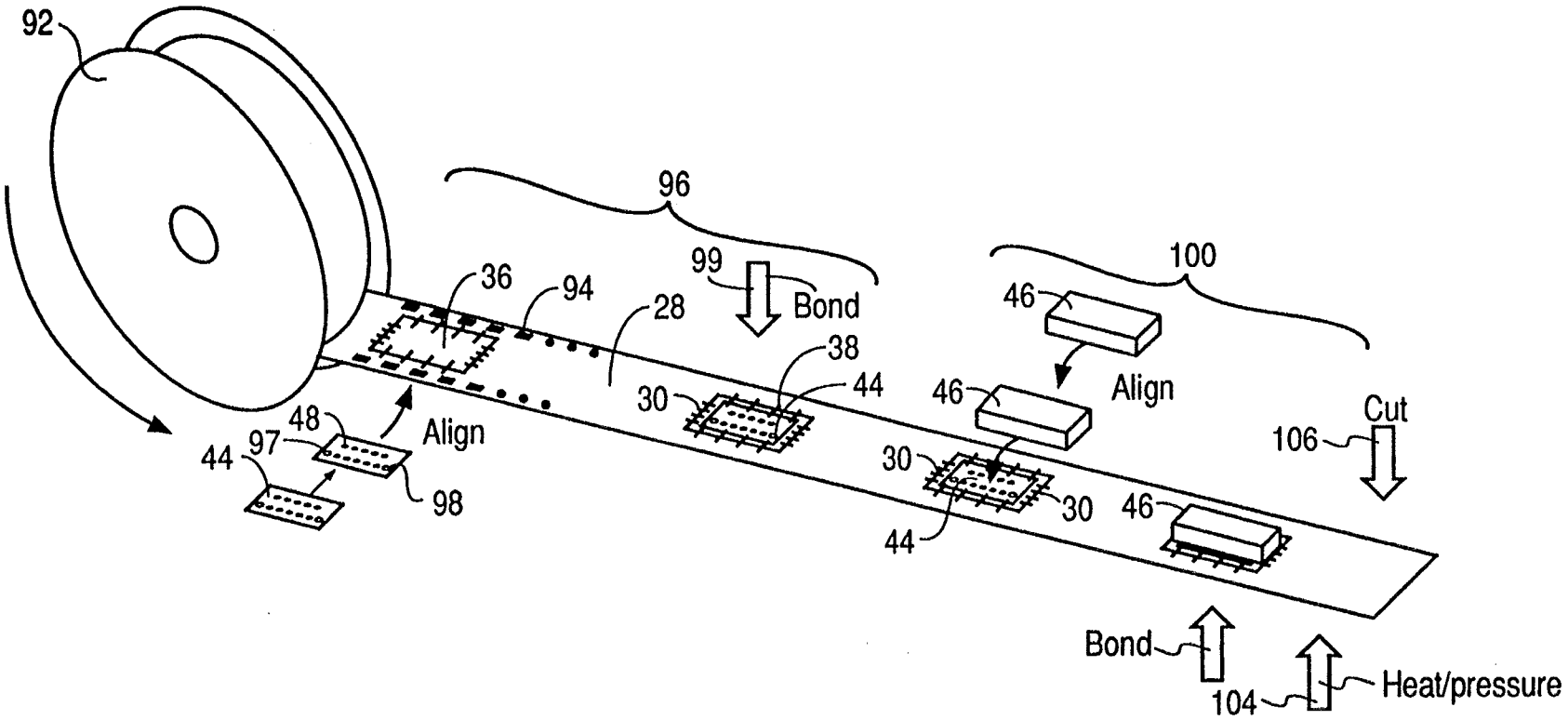
FIG. 10 illustrates one process which may be used to form the assembly of FIG. 3.

FIG. 10 illustrates a preferred method for forming the TAB printhead assembly 42 in FIG. 3.

The starting material is a Kapton TM or a Upilex TM type polymer tape 28, although tape 28 can be any suitable polymer film which is acceptable for use in the below-described procedure. Some such films may comprise teflon TM, polyimide, polymethylmethacrylate, polycarbonate, polyester, polyamide, polyethyleneterephthalate or mixtures thereof. Tape 28 is typically produced in long strips on a reel 92. Sprocket holes 94 along the sides of tape 28 are used to accurately and securely transport tape 28. Alternately, sprocket holes 94 may be omitted and the tape 28 may be transported using other methods.

In the preferred embodiment, tape 28 is already provided with conductive gold-plated copper traces 30 and 38, previously described with respect to FIG. 3. Only portions of traces 30 are shown in FIG. 10 for simplicity. The particular pattern of conductive traces 30 depends on the manner in which it is desired to distribute electrical signals to the electrodes formed on silicon dies, which are subsequently mounted on tape 28.

A first step in the preferred method is to step a portion of tape 28, having opening 36 formed therein, to an optical alignment station 96, which may be a conventional automated bonder, such as an inner lead bonder commercially available from Shinkawa Corporation, Model No. IL-20.

The bonder is supplied with individual nozzle plates 44, preferably having target holes 97 and 98 formed thereon which are formed in the same process which was used to form nozzles 48 in nozzle plate 44 so that targets 97 and 98 are precisely aligned with nozzles 48. The bonder is preprogrammed with the alignment target 97, 98 pattern on nozzle plate 44 and with an alignment target pattern formed on tape 28. Such an alignment pattern may be the pattern of traces 38.

The bonder then automatically manipulates the nozzle plates 44 until targets 97 and 98 are optically aligned with traces 38 (assuming traces 38 provide the target pattern on tape 28). The bonder then bonds traces 38 to nozzle plates 44 using, for example, a gang bonding method to press the ends of traces 38 down onto nozzle plate 44. The bonder then applies heat, such as by using thermocompression bonding, to weld the ends of traces 38 to nozzle member 44. This bonding is shown as step 99 in FIG. 10. Other types of bonding can also be used, such as ultrasonic bonding, conductive epoxy, solder paste, or other well-known means.

The above alignment features and bonding features are contained in the Shinkawa bonder, and the procedures used for automated alignment and bonding with the Shinkawa bonder (and equivalent bonders) are well known to those skilled in the art.

The alignment of nozzle plate 44 to traces 38 is not critical, and 25 microns is typical.

Tape 28 is next stepped to a second optical alignment station 100, which may also be a commercially available bonder from Shinkawa Corporation, Model No. IL-20.

The bonder at station 100 is preprogrammed with the nozzle plate 44 alignment target 97, 98 pattern and a target pattern on substrate 46. Preferably, the target pattern on substrate 46 is formed during the same process which is used to form vaporization chambers 66 or thin film resistors 64, shown in FIG. 6. A suitable target pattern may be the barrier layer insulation portions 58 which insulate conductors 30 from substrate 46.

The bonder then automatically positions the silicon substrates 46 with respect to nozzle plates 44 so as to optically align the two target patterns to an alignment within a few microns (e.g., 10 microns). This automatic alignment of the nozzle plate target 97, 98 pattern with the substrate target pattern not only precisely aligns nozzles 48 with vaporization chambers 66 but also inherently aligns electrodes 54 (FIG. 6) on substrate 46 with the ends of conductive traces 30 formed on tape 28. Thus, the alignment of substrates 46 with respect to nozzle plates 44 and with respect to conductors 30 is performed automatically using a single step and using only commercially available equipment. No special equipment has been used thus far in this process.

The automatic bonder then uses gang bonding or any other conventional bonding methods to bond the ends of conductive traces 30 to the associated substrate electrodes 54 through opening 36. The bonder may use thermocompression bonding or any other suitable bonding to weld the ends of traces 30 to the associated substrate electrodes 54.

Tape 28 is then stepped to a heat and pressure station 104 to press substrates 46 onto nozzle plates 44 and apply heat to cure any sandwiched adhesive layer 76 (FIG. 6) to physically bond substrates 46 to nozzle plates 44.

Tape 28 is then stepped to a cutting station 106 to separate the individual TAB printhead assemblies from one another to form TAB printhead assembly 42 in FIG. 3.

The individual TAB printhead assemblies 42 are then secured to a print cartridge body 12, such as shown in FIG. 8, and an adhesive seal is created, such as shown in FIG. 9, to ink-seal the TAB printhead assembly 42 with respect to the print cartridge body 12.

In another embodiment, traces 38, which are bonded to nozzle plates 44, are connected to a ground to prevent ink corrosion and to enhance protection from electrostatic discharge.

While particular embodiments of the present invention have been shown and described, it will be obvious to those skilled in the art that changes and modifications may be made without departing from this invention in its broader aspects and, therefore, the appended claims are to encompass within their scope all such changes and modifications as fall within the true spirit and scope of this invention.

What is claimed is:

1. A method for forming an inkjet printhead assembly comprising the steps of:

providing a flexible insulating tape having a first set of conductive traces formed thereon, for conducting energization signals, and having securing traces formed thereon, portions of said first set of conductive traces and portions of said securing traces located proximate to an opening formed in said flexible insulating tape;

positioning a nozzle plate, having nozzles formed therein, within said opening;

bonding said portions of said securing traces to said nozzle plate;

aligning a substrate with said nozzle plate, said substrate having a plurality of ink ejection means formed thereon, each ink ejection means being paired with an associated one of said nozzles formed in said nozzle plate; and bonding said portions of said first set of conductive traces to associated electrodes formed on said substrate.

2. The method of claim 1 wherein said securing traces comprise a second set of conductive traces formed on said flexible insulating tape during a same process used to form said first set of conductive traces.

3. The method of claim 1 further comprising the step of adhesively securing said nozzle plate to said substrate to physically bond together opposing surfaces of said substrate and said nozzle plate.

4. The method of claim 1 wherein said steps of positioning said nozzle plate within said opening and bonding said portions of said securing traces to said nozzle plate are performed by an automated bonder which optically aligns a target pattern on said nozzle plate to a target pattern on said tape and, after aligning, bonds said portions of said securing traces to said nozzle plate.

5. The method of claim 1 wherein said steps of aligning said substrate with said nozzle plate and bonding said portions of said first set of conductive traces to associated electrodes formed on said substrate are performed by an automated bonder which optically aligns a target pattern on said nozzle plate to a target pattern on said substrate and, after aligning, bonds said portions of said first set of conductive traces to said associated electrodes on said substrate.

6. The method of claim 1 wherein said nozzle plate is a metal nozzle plate and said securing traces are metal conductors.

7. The method of claim 1 wherein said ink ejection means comprise thin film resistors.

8. The method of claim 1 wherein said substrate is substantially rectangular and said nozzle plate overhangs two or more edges of said substrate, and wherein said substrate electrodes are exposed through said opening after said step of aligning said substrate with said nozzle plate.

9. The method of claim 1 wherein said method is conducted in a step-and-repeat process where said flexible insulating tape is provided on a reel, and a plurality of printhead assemblies are formed on a continuous strip of said flexible insulating tape prior to segmenting said tape into individual printhead assembly portions.

10. A printing structure comprising:

a strip of flexible insulating tape having a first set of conductive traces formed thereon for conducting energization signals and having securing traces formed thereon, portions of said first set of conductive traces and portions of said securing traces located proximate to an opening formed in said tape;

a nozzle plate, formed of a different material than said tape, being secured to said portions of said securing traces; and a substrate being aligned with and secured to said nozzle plate, said substrate having ink ejection means formed thereon, each ink ejection means being paired with a nozzle formed in said nozzle plate, said substrate having electrodes formed thereon bonded to said portions of said first set of conductive traces.

11. The structure of claim 10 wherein said securing traces are formed of a conductive material and are formed along with said first set of conductive traces on said tape.

12. The structure of claim 10 wherein said nozzle plate is secured to said tape by said securing traces prior to said substrate being secured to said nozzle plate.

13. The structure of claim 10 further comprising a print cartridge body secured to said tape, said print cartridge body providing an ink supply to said ink ejection means.

14. The structure of claim 10 wherein said ink ejection means are thin film resistors.

15. The structure of claim 10 wherein said nozzle plate is formed of a metal and said securing traces are metal conductors.

16. The structure of claim 10 wherein said substrate is substantially rectangular and said nozzle plate overhangs two or more edges of said substrate, said nozzle plate not overlying said electrodes formed on said substrate.

17. A method for forming an inkjet printhead assembly comprising the steps of:

providing a flexible insulating tape having a set of conductive traces formed thereon, for conducting energization signals, said tape having an opening;

positioning a nozzle plate, having nozzles formed therein, within said tape opening;

bonding said nozzle plate to said tape proximate to said tape opening;

aligning a substrate with said nozzle plate, said substrate having a plurality of ink ejection means formed thereon, each ink ejection means being paired with an associated one of said nozzles formed in said nozzle plate; and bonding portions of said set of conductive traces to associated electrodes formed on said substrate.

18. The method of claim 17 further comprising, after the aligning step, the step of adhesively securing said nozzle plate to said substrate to physically bond together opposing surfaces of said substrate and said nozzle plate.

19. The method of claim 17 wherein said substrate is substantially rectangular and said nozzle plate overhangs two or more edges of said substrate, and wherein said substrate electrodes are exposed through said opening after said step of aligning said substrate with said nozzle plate.

20. A printing structure comprising:

a strip of flexible insulating tape having an opening and a set of conductive traces formed on the tape for conducting energization signals, portions of said set of conductive traces located proximate to the tape opening;

a nozzle plate, formed of a different material than said tape, within said tape opening and being secured to portions of the tape surrounding the tape opening; and a substrate being aligned with and secured to said nozzle plate, said substrate having ink ejection means formed thereon, each ink ejection means being paired with a nozzle formed in said nozzle plate, said substrate having electrodes formed thereon bonded to said portions of said set of conductive traces.

21. The structure of claim 20 further comprising a print cartridge body secured to said tape, said print cartridge body providing an ink supply to said ink ejection means.

22. The structure of claim 20 wherein said substrate is substantially rectangular and said nozzle plate overhangs two or more edges of said substrate, said nozzle plate not overlying said electrodes formed on said substrate.

* * * * *